US006377917B1

(12) United States Patent
Gimenez de los Galanes et al.

(10) Patent No.: US 6,377,917 B1
(45) Date of Patent: Apr. 23, 2002

(54) SYSTEM AND METHODOLOGY FOR PROSODY MODIFICATION

(75) Inventors: Francisco M. Gimenez de los Galanes, Washington, DC (US); David Thieme Talkin, Los Gatos, CA (US)

(73) Assignee: Microsoft Corporation, Redmond, WA (US)

( * ) Notice: Subject to any disclaimer, the term of this patent is extended or adjusted under 35 U.S.C. 154(b) by 0 days.

(21) Appl. No.: 09/355,386

(22) PCT Filed: Jan. 27, 1998

(86) PCT No.: PCT/US98/01539

§ 371 Date: Nov. 4, 1999

§ 102(e) Date: Nov. 4, 1999

(87) PCT Pub. No.: WO98/35339

PCT Pub. Date: Aug. 13, 1998

Related U.S. Application Data

(60) Provisional application No. 60/036,228, filed on Jan. 27, 1997.

(51) Int. Cl.[7] ..... G10L 19/00

(52) U.S. Cl. ..... 704/220; 704/267; 704/268; 704/266

(58) Field of Search ..... 704/220, 267, 704/268, 200, 266, 258

(56) References Cited

U.S. PATENT DOCUMENTS

| | | | | |
|---|---|---|---|---|
| 5,278,943 | A | 1/1994 | Gasper et al. | 704/200 |
| 5,384,893 | A | 1/1995 | Hutchins | 704/267 |
| 5,479,564 | A | 12/1995 | Vogten et al. | 704/267 |
| 5,524,172 | A | 6/1996 | Hamon | 704/268 |

*Primary Examiner*—Richemond Dorvil
*Assistant Examiner*—Susan McFadden
(74) *Attorney, Agent, or Firm*—Theodore M. Magee; Westman, Champlin & Kelly, P.A.

(57) ABSTRACT

A prosody modification system and methodology calculates synchronization marks in an original, quasi-periodic signal to a finer precision than the sampling rate of the original signal. Synthetic synchronization marks are generated according to the desired prosody modification also to a finer precision than the sampling rate of the original signal. Waveforms are extracted from the original signal and are fine-shifted to the exact location on the synthetic time axis by a resampling technique. The fine-shifted waveforms are windowed by an asymmetric filtering window, overlapped, and summed together to produce a synthetic signal.

58 Claims, 3 Drawing Sheets

SYSTEM AND METHODOLOGY FOR PROSODY MODIFICATION

RELATED APPLICATIONS

This. application claims the benefit of U.S. Provisional Application No. 60/036,228, entitled "Method and System of Modifying Pitch Contour of Speech," filed on Jan. 27, 1997 by Francisco M. Gimenez de los Galanes, incorporated herein by reference.

FIELD OF THE INVENTION

The present invention relates to signal processing and, more particularly, to prosody modification of a quasi-periodic signal.

BACKGROUND OF THE INVENTION

Prosody modification is the adjustment of a quasi-periodic signal without affecting the timbre. Quasi-periodic signals include human speech, e.g., talking and singing, synthetic speech, and sounds from musical instruments, such as notes from woodwind, brass, or stringed instruments. Specific examples of prosody modification include adjusting the pitch of a quasi-periodic signal without affecting the timbre, for example, changing a sampled clarinet note from a C to a B while still sounding like a clarinet. Another purpose of prosody modification is to change the duration of a quasi-periodic signal without affecting either the pitch or the timbre.

Practical applications of prosody modification include adding emphasis to portions of a pre-recorded message and changing the duration of human dialog to fit a particular time slot, e.g., an advertising announcement or lip-syncing during postproduction of a movie or video. Prosody modification is also used to adjust the pitch of a singer or musical instrument, for example, to change the musical key, add vibrato, or correct for poor voice control. Speech synthesis requires prosody modification of short speech segments before concatenation to create words and longer messages.

One conventional approach to prosody modification is a pitch-synchronous overlap-and-add technique. U.S. Pat. No. 5,524,172 describes a conventional overlap-and-add system for modifying the prosody of speech synthesis segments, which are derived from human sounds sampled at a relatively low sampling rate of 16 kHz due to tight constraints in computation and storage costs. A series of original synchronization marks within the speech segment are indexed by sample number and saved in a memory. The duration of the speech segments is modified by time-warping the synchronization marks to produce a series of synthetic synchronization marks, also indexed by a sample number. Waveforms are extracted from the speech segment at the original synchronization mark using a symmetrical Hanning window, overlapped by shifting to the corresponding synthetic synchronization mark, and added to the output signal.

Conventional overlap-and-add techniques introduce some noise in the form of artificial jitter or harmonic mix-up, into the signal, which is heard as a "fuzziness" or a reedy quality. In particular, higher pitched signals, such as women's voices, children's voice, singing voices, and most musical instrument notes, are especially affected. Moreover, conventional overlap-and-add systems have difficulty with signals involving rapid changes in pitch, for example, during music such as signing or playing musical instruments.

SUMMARY OF THE INVENTION

There exists a need for a prosody modification system and methodology that reduces the introduction of noise or fuzziness in its outputs. There is also a need for effectively modifying the prosody of signals without severely affecting the musicality or compromising the desired pitch, for example, in higher-pitched signals, such as women's voices, children's voice, singing voices, and most musical instrument notes and signals involving rapid changes in pitch.

One aspect of the present invention stems from the realization that an important source of errors in the output signal of conventional overlap-and-add systems is due to the rounding synchronization of the waveforms to intervals defined by the relatively low sampling rate. However, it is not desirable to increase the sampling rate owing to the tight computational and storage constraints.

Accordingly, one aspect of the present invention is a method and computer-readable medium bearing instructions for performing a prosody modification on a quasi-periodic signal, sampled at a sampling interval. A series of original synchronization marks is determined for the quasi-periodic signal, from which a series of synthetic synchronization marks are determined in accordance with the prosodic modification. Waveforms are extracted from the quasi-periodic signal around one of the original synchronization marks, and shifted to one of the synthetic synchronization marks corresponding to the original synchronization marks. The difference of the original synchronization mark and the synthetic synchronization mark is not an integral multiple of said sampling interval. One implementation of non-integral shifting is by resampling the quasi-periodic signal. The prosody-modified signal is then generated based on the shifted waveforms, for example, by overlap-and-add techniques.

Another aspect of the present invention stems from the realization that another source of errors in conventional overlap-and-add techniques is the use of symmetric windows in extracting waveforms around synchronization marks when the pitch is rapidly changing. The symmetric windows tend to either extract too little or too much of the waveform to be overlapped-and-added.

Accordingly, a method and computer-readable medium bearing instructions are provided for synthesizing a quasi-periodic signal from an original signal. A series of original synchronization marks is determined for the quasi-periodic signal, from which a series of synthetic synchronization marks are determined in accordance with the prosodic modification. Waveforms are extracted from around one of-the original synchronization marks by applying an asymmetric filtering window and time-shifting the waveforms according to the original synchronization mark and a corresponding synthetic synchronization marks. The extracted, shifted waveforms are summed to synthesize the quasi-periodic signal. The filtering window may be defined as having a first half-width on one side of the original synchronization mark and a second half-width on another side of the original synchronization mark, in which the first half-width is different from the second half-width. In some implementations, the filtering window comprises two half-Hanning windows.

Additional needs, objects, advantages, and novel features of the present invention will be set forth in part in the description that follows, and in part, will become apparent upon examination or may be learned by practice of the invention. The objects and advantages of the invention may be realized and obtained by means of the instrumentalities and combinations particularly pointed out in the appended claims.

BRIEF DESCRIPTION OF THE DRAWINGS

The present invention is illustrated by way of example, and not by way of limitation, in the figures of the accompanying drawings and in which like reference numerals refer to similar elements and in which.

DESCRIPTION OF THE PREFERRED EMBODIMENT

A method and apparatus for prosody modification is described. In the following description, for the purposes of explanation, numerous specific details are set forth in order to provide a thorough understanding of the present invention. It will be apparent, however, to one skilled in the art that the present invention may be practiced without these specific details. In other instances, well-known structures and devices are shown in block diagram form in order to avoid unnecessarily obscuring the present invention.

HARDWARE OVERVIEW

Figure 1:
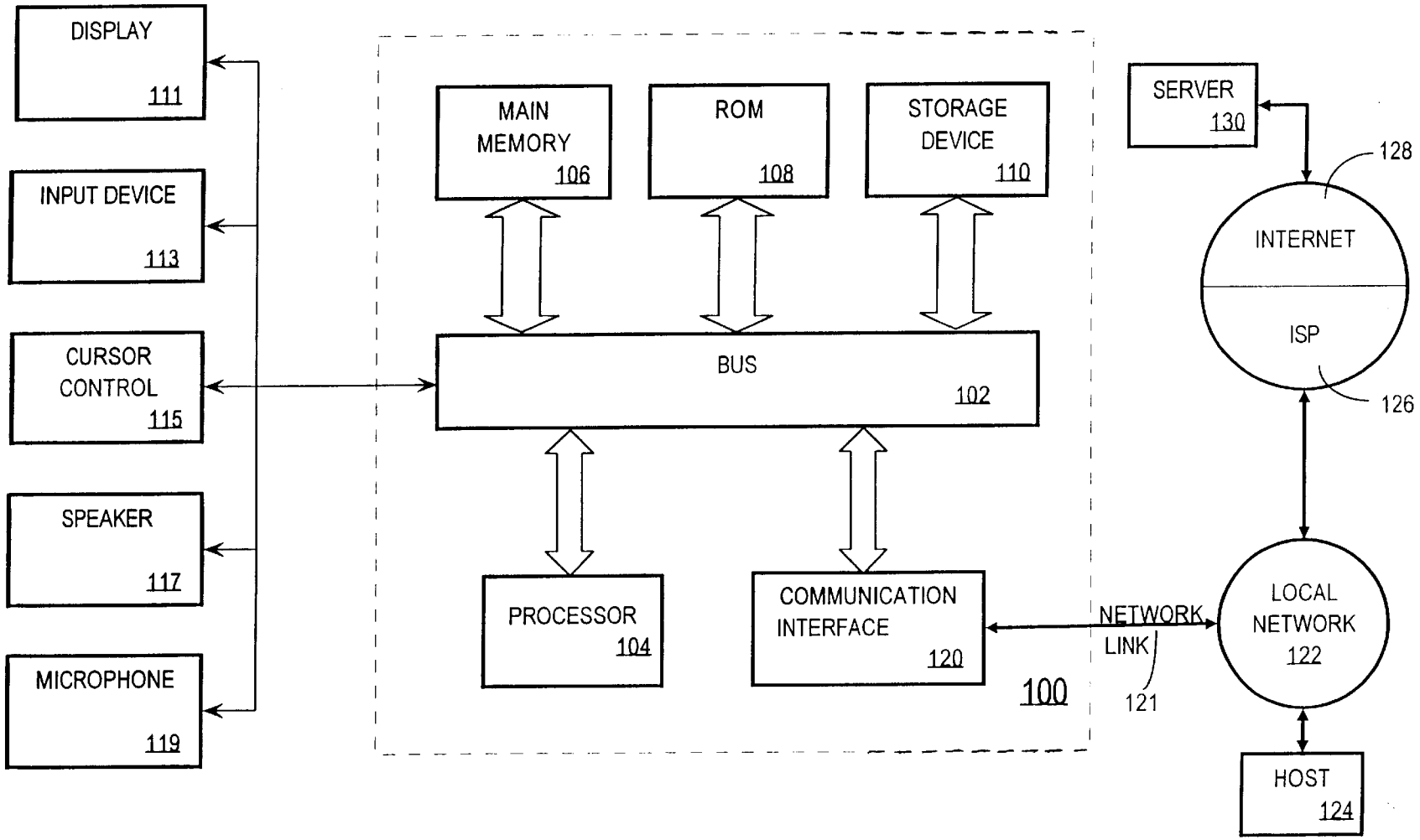
FIG. 1 schematically depicts a computer system that can implement the present invention.

FIG. 1 is a block diagram that illustrates a computer system 100 upon which an embodiment of the invention may be implemented. Computer system 100 includes a bus 102 or other communication mechanism for communicating information, and a processor (or a plurality of central processing units working in cooperation) 104 coupled with bus 102 for processing information. Computer system 100 also includes a main memory 106, such as a random access memory (RAM) or other dynamic storage device, coupled to bus 102 for storing information and instructions to be executed by processor 104. Main memory 106 also may be used for storing temporary variables or other intermediate information during execution of instructions to be executed by processor 104. Computer system 100 further includes a read only memory (ROM) 108 or other static storage device coupled to bus 102 for storing static information and instructions for processor 104. A storage device 110, such as a magnetic disk or optical disk, is provided and coupled to bus 102 for storing information and instructions.

Computer system 100 may be coupled via bus 102 to a display 111, such as a cathode ray tube (CRT), for displaying information to a computer user. An input device 113, including alphanumeric and other keys, is coupled to bus 102 for communicating information and command selections to processor 104. Another type of user input device is cursor control 115, such as a mouse, a trackball, or cursor direction keys for communicating direction information and command selections to processor 104 and for controlling cursor movement on display 111. This input device typically has two degrees of freedom in two axes, a first axis (e.g., x) and a second axis (e.g., y), that allows the device to specify positions in a plane. For audio output and input, computer system 100 may be coupled to a speaker 117 and a microphone 119, respectively.

The invention is related to the use of computer system 100 for prosody modification. According to one embodiment of the invention, prosody modification is provided by computer system 100 in response to processor 104 executing one or more sequences of one or more instructions contained in main memory 106. Such instructions may be read into main memory 106 from another computer-readable medium, such as storage device 110. Execution of the sequences of instructions contained in main memory 106 causes processor 104 to perform the process steps described herein. One or more processors in a multi-processing arrangement may also be employed to execute the sequences of instructions contained in main memory 106. In alternative embodiments, hard-wired circuitry may be used in place of or in combination with software instructions to implement the invention. Thus, embodiments of the invention are not limited to any specific combination of hardware circuitry and software.

The term "computer-readable medium" as used herein refers to any medium that participates in providing instructions to processor 104 for execution. Such a medium may take many forms, including but not limited to, non-volatile media, volatile media, and transmission media Non-volatile media include, for example, optical or magnetic disks, such as storage device 110. Volatile media include dynamic memory, such as main memory 106. Transmission media include coaxial cables, copper wire and fiber optics, including the wires that comprise bus 102. Transmission media can also take the form of acoustic or light waves, such as those generated during radio frequency (RF) and infrared (IR) data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, and EPROM, a FLASH-EPROM, any other memory chip or cartridge, a carrier wave as described hereinafter, or any other medium from which a computer can read.

Various forms of computer readable media may be involved in carrying one or more sequences of one or more instructions to processor 104 for execution. For example, the instructions may initially be borne on a magnetic disk of a remote computer. The remote computer can load the instructions into its dynamic memory and send the instructions over a telephone line using a modem. A modem local to computer system 100 can receive the data on the telephone line and use an infrared transmitter to convert the data to an infrared signal. An infrared detector coupled to bus 102 can receive the data carried in the infrared signal and place the data on bus 102. Bus 102 carries the data to main memory 106, from which processor 104 retrieves and executes the instructions. The instructions received by main memory 106 may optionally be stored on storage device 110 either before or after execution by processor 104.

Computer system 100 also includes a communication interface 120 coupled to bus 102. Communication interface 120 provides a two-way data communication coupling to a network link 121 that is connected to a local network 122. Examples of communication interface 120 include an integrated services digital network (ISDN) card, a modem to provide a data communication connection to a corresponding type of telephone line, and a local area network (LAN) card to provide a data communication connection to a compatible LAN. Wireless links may also be implemented. In any such implementation, communication interface 120 sends and receives electrical, electromagnetic or optical signals that carry digital data streams representing various types of information.

Network link 121 typically provides data communication through one or more networks to other data devices. For example, network link 121 may provide a connection through local network 122 to a host computer 124 or to data equipment operated by an Internet Service Provider (ISP) 126. ISP 126 in turn provides data communication services through the world wide packet data communication network, now commonly referred to as the "Internet" 128. Local network 122 and Internet 128 both use electrical, electromagnetic or optical signals that carry digital data streams. The signals through the various networks and the signals on network link 121 and through communication interface 120, which carry the digital data to and from computer system 100, are exemplary forms of carrier waves transporting the information.

Computer system 100 can send messages and receive data, including program code, through the network(s), network link 121 and communication interface 120. In the Internet example, a server 130 might transmit a requested code for an application program through Internet 128, ISP 126, local network 122 and communication interface 118. In accordance with the invention, one such downloaded application provides for prosody modification as described herein. The received code may be executed by processor 104 as it is received, and/or stored in storage device 110, or other non-volatile storage for later execution. In this manner, computer system 100 may obtain application code in the form of a carrier wave.

PROSODY MODIFICATION

Figure 2:
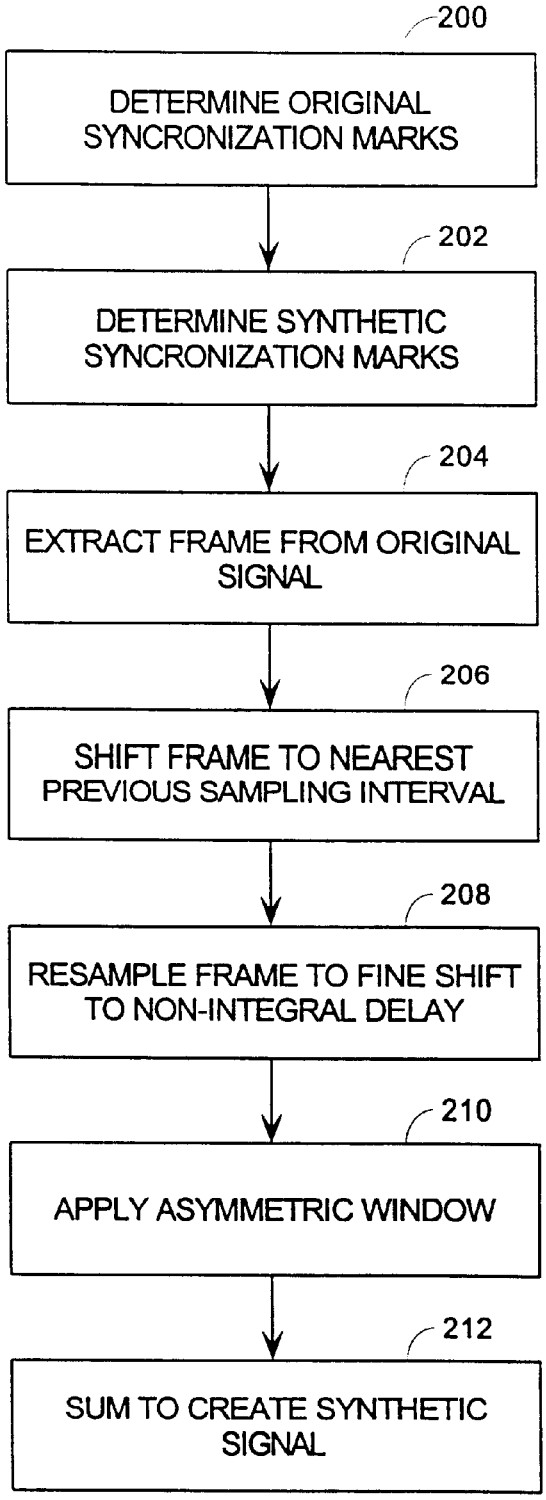
FIG. 2 is a flowchart illustrating the operation of an embodiment of the present invention.

FIG. 2 is a flowchart illustrating the operation of prosody modification of an original quasi-periodic signal into a synthetic signal, according to one embodiment of the present invention. In step 200, a series of original synchronization marks is established for the original signal. In contrast to conventional methodologies, the original synchronization marks are calculated to a greater precision than the sampling rate under which the original signal is processed. For example, if the processing sampling rate is 16 kHz, synchronization marks in the original signal may be established to a resolution of 21 $\mu$s, although the signal is sampled for processing in intervals of about 63 $\mu$s. One approach to is to determine the synchronization mark on an upsampled version of the original signal, for example, at a rate that is at least three times faster than the processing sampling rate. Another approach, which does not use upsampling but mathematical curve fitting, is described in more detail herein below.

Figure 3A:
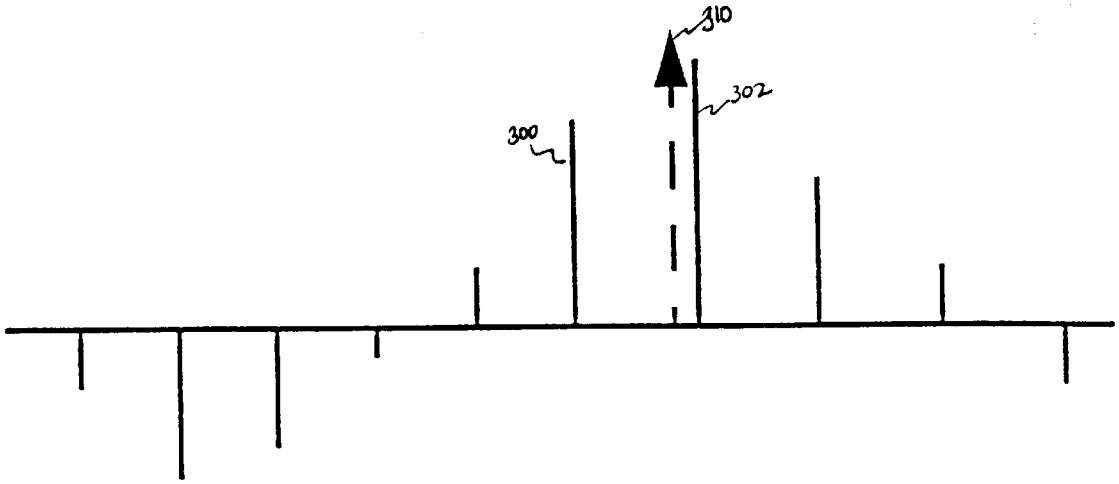
FIGS. 3(*a*) and 3(*b*) depict an exemplary sampled signal with an original synchronization mark and a synthetic synchronization mark.
Figure 3B:
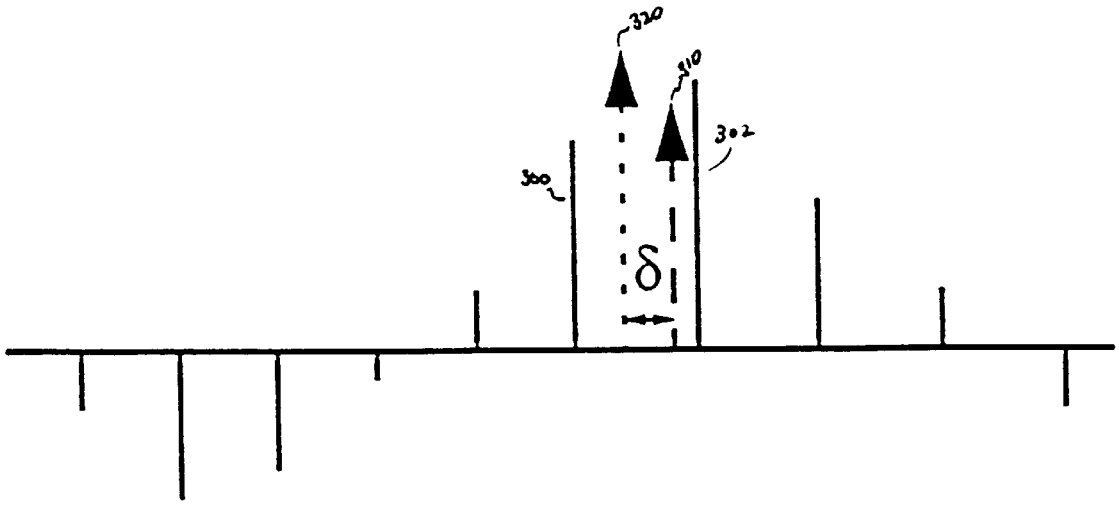

Referring to FIG. 3(*a*), a sampled, quasi-periodic signal is depicted, in which an original synchronization mark 310 is located between sample 300 and sample 302. Sample 300 is an amplitude of the original, quasi-periodic signal at an instant in time, and sample 302 is an amplitude of the same quasi-periodic signal at a later instant in time. The interval between sample 300 and sample 302 is the sampling period. Original synchronization mark 310 is calculated to a finer resolution than the sampling rate, and therefore is not necessarily coincident with any of the samples in the sampled original signal. In FIG. 3(*a*), original synchronization mark 310 is roughly 80% of the way from sample 300 to sample 302.

The original synchronization marks can be established by a variety of means, and, for human speech, the synchronization marks are preferably aligned to glottal closure instants, called "epochs." An epoch occurs when the glottis, which is the space between the vocal cords at the upper part of the larynx, closes and causes a "ring-down" damping effect in the vocal signal. A convenient definition of the time of glottal closure is the instant at which there is a maximum rate of change in the airflow through the glottis. One approach to finding the epochs is by application of standard epoch detection methods on an upsampled version of the original signal, for example, at about 48 kHz. Another approach to finding the epochs, also on an upsampled signal, uses fundamental frequency tracking as described in D. Talkin, "A Robust Algorithm for Pitch Tracking (RAPT), "*Speech Coding & Synthesis*, Kleijn & Paliwal eds., (Amsterdam: Elsevier, 1995), in which a fundamental frequency $f_0$ is detected using cross-correlation and dynamic programming techniques. The detected fundamental frequency is combined with peaks picked from an integrated linear predictive coding residual in a dynamic programming framework that finds the set of epochs most consistent with the local estimates of the fundamental frequency $f_0$. Still another approach, which does not involve explicit upsampling, is to fit a function such as a polynomial to the speech signal in the vicinity of the peak, and then use analytic techniques to find the peak in the function nearest the coarse epoch estimate obtained at the original sampling rate.

Referring back to FIG. 2, in step 202, a series of synthetic synchronization marks is generated based on prosody modification information such as a desired fundamental frequency contour and a desired time-warping function, as by iteratively integrating the desired fundamental frequency contour and the desired time-warping function. The time-warping function establishes a projection of the original and synthetic time axes that determines a frame-level mapping from segments of the original waveform to a time on the synthetic axis. When the combination of the fundamental frequency and the time-scale modification implies a denser or sparser set of synchronization marks, frames are repeated or omitted, respectively, to compensate.

Unlike conventional techniques, the synthetic synchronization marks are not quantized to the signal sampling frequency intervals, but to a finer resolution than the sampling interval, preferably limited only by the precision of the underlying hardware. For example, the mantissa of a 32-bit floating number provides 24 bits of resolution. Referring to FIG. 3(*b*), a synthetic synchronization mark 320 is depicted lying between sample 300 and sample 302. The synthetic synchronization mark 320 will not generally occur at the same location of the corresponding original synchronization mark 310 and will be offset from the original synchronization mark 310 by some delay $\delta$. Delay $\delta$ is not necessarily an integral multiple of the sampling interval (the period between sample 300 and sample 302), and in fact may be a fraction of one sampling interval.

GENERATING SYNTHETIC FRAMES

After the original and synthetic synchronization marks are generated, waveforms from the original signal are extracted by applying a filtering window around an original synchronization mark in step 204. This filtering window can be a rectangular window that defines a frame from the previous synchronization mark to the next synchronization mark. Thus, a frame comprises two periods: the first period from the previous synchronization mark to the current synchronization mark, and the second period from the current synchronization mark to the next synchronization mark. However, other implementations may employ a raised cosine window such as a Hamming window, a symmetric Hanning window, or an asymmetric Hanning window, which is described in more detail herein below in conjunction with step 210, or other center-weighted window.

After waveforms in the selected frame are extracted from the original signal from around an original synchronization mark, the waveforms are shifted to the corresponding synthetic synchronization mark. According to one embodiment of the present invention, the extracted waveforms are shifted by a two-step process. First, the selected frame is shifted to the closest sampling interval that is before the synthetic synchronization mark (step 206), as by conventional techniques.

The second step is a fine-shifting step that moves the frame to the exact position in time for the synthetic synchronization mark (step 208). One approach to fine-shifting is to reconstruct the original signal from its samples and resample the original signal again after introducing the desired delay in the analog domain. The resampling of the original signal can be performed digitally by upsampling the digital signal (i.e., the sampled original signal), applying a digital reconstruction filter at that higher sampling rate, introducing an integer delay at that upsampling rate, and downsampling the delayed signal down to the original sampling rate. The upsampling rate is determined by the admissible quantization of the delay at the higher sampling rate. Using a sinc(x) reconstruction filter, the resampled signal can be expressed by the following equation:

$$y[m] = \sum_{n=-\infty}^{\infty} x[n]\left(\frac{\sin\alpha\pi}{\pi}\right)\frac{-1^{(m-n)}}{(m-n)+\alpha}, \tag{1}$$

where x[n] is the gross-shifted original signal, y[m] is the fine-shifted signal, and $\alpha$ is the quotient of the fine delay $\delta$ and the sampling period $T_s$. In practice, the limits of the summation are constrained to a sensible integer value such as 40, which introduces some distortion in the resulting signal. This distortion, however, can be reduced by applying a tapering window as explained in F. M. Gimenez de los Galanes et al., "Speech Synthesis System Based on a Variable Decimation/Interpolation Factor," *IEEE Proc. ICASSP* '95 (Detroit: 1995). Other prosody modifications may be applied at this point, for example, controlling emphasis by multiplying the waveforms by a gain factor.

Signal Synthesis

After the extracted waveforms have been fine-shifted, the shifted waveforms are combined to produce the synthesized signal, preferably by application of the following, overlap-and-add technique to account for rapid changes in pitch. In step 210, an asymmetric window is applied to extract an overlapping frame. More specifically, according to one embodiment of the present invention, the first section of the asymmetric window is half of a Hanning window, increasing in amplitude from 0 to a non-zero value such as 1, with a length that is the lesser of the length of the first original period and the first synthetic period. The second section of the asymmetric window is half of a Hanning window, decreasing in amplitude from the non-zero value to 0, with a length that is the lesser of the length of the second original period and the second synthetic period. It is evident that other filtering windows may be employed, for example, an inherently asymmetric window such as a gamma function or halves of symmetric windows such as a Hamming window or other raised cosine window. The asymmetric windowing strategy reduces the distortion in the windowing step of an overlap-and-add technique by not extracting too little or too much of the waveform.

In the embodiment of the present invention illustrated in the flowchart of FIG. 2, the asymmetric windowing is applied to a time-shifted waveform. However, in another embodiment of the present invention, the waveform is first extracted by an asymmetric window and then time-shifted, even by conventional techniques. After the windowed, time-shifted waveform is extracted, it is summed with other overlapping windowed, time-shifted waveforms to create the synthetic signal in accordance with conventional overlap-and-add techniques (step 212).

While this invention has been described in connection with what is presently considered to be the most practical and preferred embodiment, it is to be understood that the invention is not limited to the disclosed embodiment, but on the contrary, is intended to cover various modifications and equivalent arrangements included within the spirit and scope of the appended claims.

What is claimed is:

1. A method of performing a prosody modification on a quasi-periodic signal, sampled at a sampling interval, to produce a modified signal, said method comprising the machine-implemented steps of:

determining a series of original synchronization marks in said quasi-periodic signal;

determining a series of synthetic synchronization marks based on said original synchronization marks and said prosodic modification;

extracting waveforms from said quasi-periodic signal around one of said original synchronization marks;

shifting said waveforms to one of said synthetic synchronization marks corresponding to said one of said original synchronization marks to produce shifted waveforms, wherein a difference of said one of said original synchronization marks and said one of said synthetic synchronization marks is a non-integral multiple of said sampling interval; and generating said modified signal based on said shifted waveforms.

2. A method as in claim 1, wherein the step of determining a series of original synchronization marks in said quasi-periodic signal includes the step of determining at least one of said original synchronization marks at a resolution finer than the sampling interval.

3. A method as in claim 2, wherein the step of determining at least one of said original synchronization marks at a resolution finer than the sampling interval includes the step of sampling the quasi-periodic signal at a shorter sampling interval with respect to said sampling interval.

4. A method as in claim 2, wherein the step of determining at least one of said original synchronization marks at a resolution finer than the sampling interval includes fitting a mathematical curve to find a peak in said quasi-periodic signal.

5. A method as in claim 3, wherein said shorter sampling interval is at most one-third of said sampling interval.

6. A method as in claim 1, wherein the step of determining a series of original synchronization marks in said quasi-periodic signal includes the step of determining epochs in said quasi-periodic signal.

7. A method as in claim 1, wherein the step of determining a series of synthetic synchronization marks includes the step of determining at least one of said synthetic synchronization marks at a resolution finer than the sampling interval.

8. A method as in claim 7, wherein the step of determining at least one of said synthetic synchronization marks at a resolution finer than the sampling interval includes the step of determining said at least one of said synthetic synchronization marks by a floating point number having a mantissa of at least twenty-four bits.

9. A method as in claim 1, wherein the step of shifting said waveforms to one of said synthetic synchronization marks corresponding to said one of said original synchronization marks includes the step of resampling said waveforms to adjust said waveforms to said one of said synthetic synchronization marks.

10. A method as in claim 9, wherein the step of shifting said waveforms to one of said synthetic synchronization marks corresponding to said one of said original synchronization marks further includes the step of shifting said waveforms to the nearest previous sampling interval of said one of said synthetic synchronization marks, before said step of resampling is performed.

11. A method as in claim 1, wherein the step of generating said modified signal based on said shifted waveforms includes the steps of:

applying an asymmetric filtering window to said shifted waveforms; and summing the windowed, shifted waveform to generate said modified signal.

12. A method as in claim 11, wherein:

said asymmetric filtering window has a first section and a second section in juxtaposition with each other;

said first section has an amplitude progressively increasing from zero to a non-zero value along a first width;

said second section has an amplitude progressively decreasing from said non-zero value to zero along a second width; and said first width is different in size from said second width.

13. A method as in claim 12, wherein:

said first width is the lesser of the interval between said one of said original synchronization marks and a preceding original synchronization mark and the interval between said one of said synthetic synchronization marks and a preceding synthetic synchronization mark; and said second width is the lesser of the interval between said one of said original synchronization marks and a subsequent original synchronization mark and the interval between said one of said synthetic synchronization marks and a subsequent synthetic synchronization mark.

14. A method as in claim 13, wherein:

said first section is the first half of a Hanning window; and said second section is the second half of a Hanning window.

15. A method of synthesizing a quasi-periodic signal from an original signal, said method comprising the steps of:

determining a series of original synchronization marks in said original signal;

determining a series of synthetic synchronization marks based on said original synchronization marks and on prosody information;

extracting a waveform from around each of said original synchronization marks by applying a filtering window and time-shifting each waveform according to a respective one of said original synchronization marks and a respective one of said synthetic synchronization marks corresponding to said respective one of said original synchronization marks, wherein each filtering window has a first half-width on one side of a respective original synchronization mark and a second half-width on another side of the respective original synchronization mark, and said first half-width is the lesser of the interval between said respective one of said original synchronization marks and a preceding original synchronization mark and the interval between said respective one of said synthetic synchronization marks and a preceding synthetic synchronization mark; and summing the extracted waveforms to synthesize said quasi-periodic signal.

16. A method as in claim 15, wherein said step of windowing is performed before said step of time-shifting.

17. A method as in claim 15, wherein:

said filtering window has a first section and a second section in juxtaposition with each other;

said first section has an amplitude progressively increasing from zero to a non-zero value along said first half-width; and said second section has amplitude progressively decreasing from said non-zero value to zero along said second half-width.

18. A method as in claim 17, wherein:

said second half-width is the lesser of the interval between said one of said original synchronization marks and a subsequent original synchronization mark and the interval between said one of said synthetic synchronization marks and a subsequent synthetic synchronization mark.

19. A method as in claim 18, wherein:

said first section is the first half of a Hanning window; and said second section is the second half of a Hanning window.

20. A method as in claim 15, wherein said step of windowing is performed after said step of time-shifting.

21. A method as in claim 15, wherein a difference of said one of said original synchronization marks and said one of said synthetic synchronization marks is a non-integral multiple of said sampling interval.

22. A method as in claim 21, wherein the step of determining a series of original synchronization marks in said quasi-periodic signal includes the step of determining at least one of said original synchronization marks at a resolution finer than the sampling interval.

23. A method as in claim 22, wherein the step of determining at least one of said original synchronization marks at a resolution finer than the sampling interval includes the step of sampling the quasi-periodic signal at a shorter sampling interval with respect to said sampling interval.

24. A method as in claim 23, wherein said shorter sampling interval is at most one-third of said sampling interval.

25. A method as in claim 21, wherein the step of determining a series of original synchronization marks in said quasi-periodic signal includes the step of determining epochs in said quasi-periodic signal.

26. A method as in claim 21, wherein the step of determining a series of synthetic synchronization marks includes the step of determining at least one of said synthetic synchronization marks at a resolution finer than the sampling interval.

27. A method as in claim 26, wherein the step of determining at least one of said synthetic synchronization marks at a resolution finer than the sampling interval includes the step of determining said at least one of said synthetic synchronization marks by a floating point number having a mantissa of at least twenty-four bits.

28. A method as in claim 21, wherein the step of shifting said waveforms to one of said synthetic synchronization marks corresponding to said one of said original synchronization marks includes the step of resampling said waveforms to adjust said waveforms to said one of said synthetic synchronization marks.

29. A method as in claim 28, wherein step of shifting said waveforms to one of said synthetic synchronization marks corresponding to said one of said original synchronization marks further includes the step of shifting said waveforms to the nearest previous sampling interval of said one of said synthetic synchronization marks, before said step of resampling is performed.

30. A computer-readable medium bearing instructions for performing a prosody modification on a quasi-periodic signal, sampled at a sampling interval, to produce a modified signal, said instructions arranged, when executed, to cause one or more processors to perform the steps of:

determining a series of original synchronization marks in said quasi-periodic signal;

determining a series of synthetic synchronization marks based on said original synchronization marks and said prosodic modification;

extracting waveforms from said quasi-periodic signal around one of said original synchronization marks;

shifting said waveforms to one of said synthetic synchronization marks corresponding to said one of said original synchronization marks, wherein a difference of said one of said original synchronization marks and said one of said synthetic synchronization marks is a non-integral multiple of said sampling interval; and generating said modified signal based on said shifted waveforms.

31. A computer-readable medium as in claim 30, wherein the step of determining a series of original synchronization marks in said quasi-periodic signal includes the step of determining at least one of said original synchronization marks at a resolution finer than the sampling interval.

32. A computer-readable medium as in claim 31, wherein the step of determining at least one of said original synchronization marks at a resolution finer than the sampling interval includes the step of sampling the quasi-periodic signal at a shorter sampling interval with respect to said sampling interval.

33. A computer-readable medium as in claim 32, wherein said shorter sampling interval is at most one-third of said sampling interval.

34. A method as in claim 31, wherein the step of determining at least one of said original synchronization marks at a resolution finer than the sampling interval includes fitting a mathematical curve to find a peak in said quasi-periodic signal.

35. A computer-readable medium as in claim 30, wherein the step of determining a series of original synchronization marks in said quasi-periodic signal includes the step of determining epochs in said quasi-periodic signal.

36. A computer-readable medium as in claim 30, wherein the step of determining a series of synthetic synchronization marks includes the step of determining at least one of said synthetic synchronization marks at a resolution finer than the sampling interval.

37. A computer-readable medium as in claim 36, wherein the step of determining at least one of said synthetic synchronization marks at a resolution finer than the sampling interval includes the step of determining said at least one of said synthetic synchronization marks by a floating point number having a mantissa of at least twenty-four bits.

38. A computer-readable medium as in claim 30, wherein the step of shifting said waveforms to one of said synthetic synchronization marks corresponding to said one of said original synchronization marks includes the step of resampling said waveforms to adjust said waveforms to said one of said synthetic synchronization marks.

39. A computer-readable medium as in claim 38, wherein the step of shifting said waveforms to one of said synthetic synchronization marks corresponding to said one of said original synchronization marks further includes the step of shifting said waveforms to the nearest previous sampling interval of said one of said synthetic synchronization marks, before performed said step of resampling.

40. A computer-readable medium as in claim 30, wherein the step of generating said modified signal based on said shifted waveforms includes the steps of:

applying an asymmetric filtering window to said shifted waveforms; and summing the windowed, shifted waveform to generate said modified signal.

41. A computer-readable medium as in claim 40, wherein:

said asymmetric filtering window has a first section and a second section in juxtaposition with each other;

said first section has an amplitude progressively increasing from zero to a non-zero value along a first width;

said second section has amplitude progressively decreasing from said non-zero value to zero along a second width; and said first width is different is size from said second width.

42. A computer-readable medium as in claim 41, wherein:

said first width is the lesser of the interval between said one of said original synchronization marks and a preceding original synchronization mark and the interval between said one of said synthetic synchronization marks and a preceding synthetic synchronization mark; and said second width is the lesser of the interval between said one of said original synchronization marks and a subsequent original synchronization mark and the interval between said one of said synthetic synchronization marks and a subsequent synthetic synchronization mark.

43. A computer-readable medium as in claim 42, wherein:

said first section is the first half of a Hanning window; and said second section is the second half of a Hanning window.

44. A computer-readable medium bearing instructions for synthesizing a quasi-periodic signal from an original signal, said instructions arranged, when executed, to cause one or more processors to perform the steps of:

determining a series of original synchronization marks in said original signal;

determining a series of synthetic synchronization marks based on said original synchronization marks and on prosody information;

extracting a waveform from around each of said original synchronization marks by applying a filtering window and time-shifting each waveform according to a respective one of said original synchronization marks and a respective one of said synthetic synchronization marks corresponding to said respective one of said original synchronization marks to form a time-shifted signal;

applying asymmetric filtering windows to the time-shifted signal to extract overlapping frames; and summing the overlapping frames to synthesize said quasi-periodic signal.

45. A computer-readable medium as in claim 44, wherein each said asymmetric filtering window has a first half-width on one side of a respective original synchronization mark and a second half-width on another side of the respective original synchronization mark, said first half-width different in size from said second half-width.

46. A computer-readable medium as in claim 45, wherein:

said asymmetric filtering window has a first section and a second section in juxtaposition with each other;

said first section has an amplitude progressively increasing from zero to a non-zero value along said first half-width; and said second section has an amplitude progressively decreasing from said non-zero value to zero along said second half-width.

47. A computer-readable medium as in claim 46, wherein:

said first half-width is the lesser of the interval between said one of said original synchronization marks and a preceding original synchronization mark and the interval between said one of said synthetic synchronization marks and a preceding synthetic synchronization mark; and said second half-width is the lesser of the interval between said one of said original synchronization marks and a subsequent original synchronization mark and the interval between said one of said synthetic synchronization marks and a subsequent synthetic synchronization mark.

48. A computer-readable medium as in claim 47, wherein:

said first section is the first half of a Hanning window; and said second section is the second half of a Hanning window.

49. A computer-readable medium as in claim 44, wherein the step of windowing is performed after the step of time-shifting.

50. A computer-readable medium as in claim 45, wherein a difference of said one of said original synchronization marks and said one of said synthetic synchronization marks is a non-integral multiple of said sampling interval.

51. A computer-readable medium as in claim 50, wherein the step of determining a series of original synchronization marks in said quasi-periodic signal includes the step of determining at least one of said original synchronization marks at a resolution finer than the sampling interval.

52. A computer-readable medium as in claim 51, wherein the step of determining at least one of said original synchronization marks a t a resolution finer than the sampling interval includes the step of sampling the quasi-periodic signal at a shorter sampling interval with respect to said sampling interval.

53. A computer-readable medium as in claim 52, wherein said shorter sampling interval is at most one-third of said sampling interval.

54. A computer-readable medium as in claim 50, wherein the step of determining a series of original synchronization marks in said quasi-periodic signal includes the step of determining epochs in said quasi-periodic signal.

55. A computer-readable medium as in claim 50, wherein the step of determining a series of synthetic synchronization marks includes the step of determining at least one of said synthetic synchronization marks at a resolution finer than the sampling interval.

56. A computer-readable medium as in claim 55, wherein the step of determining at least one of said synthetic synchronization marks at a resolution finer than the sampling interval includes the step of determining said at least one of said synthetic synchronization marks by a floating point number having a mantissa of at least twenty-four bits.

57. A computer-readable medium as in claim 50, wherein the step of shifting said waveforms to one of said synthetic synchronization marks corresponding to said one of said original synchronization marks includes the step of resampling said waveforms to adjust said waveforms to said one of said synthetic synchronization marks.

58. A computer-readable medium as in claim 57, wherein step of shifting said waveforms to one of said synthetic synchronization marks corresponding to said one of said original synchronization marks further includes the step of shifting said waveforms to the nearest previous sampling interval of said one of said synthetic synchronization marks, before performed said step of resampling.

* * * * *